United States Patent [19]

Bosch et al.

[11] Patent Number: 4,826,059

[45] Date of Patent: May 2, 1989

[54] MAGNETIC TOOL HOLDER

[76] Inventors: A. Allen Bosch, 9300 Claremont, NE., Albuquerque, N. Mex. 87112; Robert D. Dyer, 735 Forest Rd., Sandia Park, N. Mex. 87047

[21] Appl. No.: 76,333

[22] Filed: Jul. 22, 1987

[51] Int. Cl.[4] ..... B65D 73/00; A45C 11/26

[52] U.S. Cl. ..... 224/183; 224/226; 224/250; 224/901; 224/904; 224/907; 335/303; 248/309.4; 211/DIG. 1; 206/350; 206/818

[58] Field of Search ..... 206/349, 350, 818; 224/224, 226, 232, 209, 210, 259, 261, 901, 904, 907, 183, 191, 250; 335/303, 306, 285, 296, 302; 248/206.5, 309.4; 211/DIG. 1; 2/94, 48

[56] References Cited

U.S. PATENT DOCUMENTS

| | | | |
|---|---|---|---|
| 361,248 | 4/1887 | Winton . | |
| 2,580,099 | 12/1951 | Jaeger | 175/367 |
| 3,204,776 | 9/1964 | Brown et al. | 211/87 |
| 3,229,820 | 1/1966 | Hentzi et al. | 211/60.1 |
| 3,337,100 | 8/1967 | Berning | 224/183 X |
| 3,861,521 | 1/1975 | Burtz | 335/303 X |
| 3,886,508 | 5/1975 | Lavrard | 335/285 |
| 3,924,212 | 12/1975 | Brown | 335/303 |
| 3,944,069 | 3/1976 | Eldridge, Jr. | 206/350 |
| 4,373,629 | 2/1983 | Ulin et al. | 206/350 |
| 4,451,810 | 5/1984 | Miller | 335/285 |
| 4,482,049 | 11/1984 | Kot, II | 206/818 X |
| 4,637,513 | 1/1987 | Eldridge, Jr. | 206/818 X |

FOREIGN PATENT DOCUMENTS

| | | | |
|---|---|---|---|
| 580976 | 8/1959 | Canada | 224/183 |
| 1359867 | 3/1964 | France . | |
| 2565152 | 12/1985 | France | 224/183 |

*Primary Examiner*—Henry J. Recla
*Assistant Examiner*—Ernest G. Cusick
*Attorney, Agent, or Firm*—Deborah A. Peacock; Robert W. Weig

[57] ABSTRACT

The invention relates to a portable and foldable magnetic tool holder. The magnetic tool holder has a front face and a rear face and includes at least one set of a plurality of magnetic bars which are positioned side by side on the interior of the holder, such that both faces of the holder are magnetic. Preferably, the holder contains an apron and can be folded in multiple directions.

9 Claims, 2 Drawing Sheets

MAGNETIC TOOL HOLDERcl BACKGROUND OF THE INVENTION

Users of tools in assembly or repair work, or even home and office work, often encounter a need to have easy access to and portability of tools. The flexible magnetic tool holder of the present invention is portable and can conform to various contoured mounting surfaces, including the human body.

There are several devices in the prior art which are used to hold metallic items or tools. U.S. Pat. No. 361,248, entitled HOLDER FOR METAL ARTICLES, to Winton; U.S. Pat. No. 2,580,099, entitled DOUBLE MAGNETIC HOLDING DEVICE, to Jaeger; U.S. Pat. No. 3,204,776, entitled MAGNETIC TOOL BOARD, to Brown et al.; U.S. Pat. No. 3,229,820, entitled MAGNETIC HOLDER, to Hentzi et al.; and U.S. Pat. No. 4,451,810, entitled MAGNETIC TOOL HOLDER, to Miller; all disclose the use of rigid, inflexible magnetic holders which will not conform to various contoured mounting surfaces Each device requires a permanent mounting base and each must be nailed or otherwise affixed in place. The magnets of these devices are used solely to hold the tools and are not used to mount the holder in position.

U.S. Pat. No. 3,886,508, entitled MAGNETIC TOOL HOLDER, to Lavrard, discloses several garment supports for magnetic tool holders. However, the garment supports are extremely bulky, making the tool holder uncomfortable to wear. Because of these bulky supports, the tool holder cannot be easily positioned on surfaces other than a human body.

Several prior art patents disclose the use of magnets incorporated into a flexible material to protect automobile fenders. French Patent No. 1,359,867, entitled PROTÈGE-AILE MAGNETIQUE, to Mounier, discloses a curtain which is placed over a fender to protect the fender paint while the automobile is being serviced. The curtain is held in place by a series of single magnetic bars placed within one edge of the curtain. This patent does not disclose or imply using the magnetic bars to hold tools.

U.S. Pat. No. 3,924,212, entitled FENDER PROTECTOR CLOTH WITH FLEXIBLE MAGNETIC STRIPS, to Brown, discloses the use of magnetic rubber strips in a fender protector. The strips are spaced at predetermined intervals on the exterior of both sides of the protector to hold the protector in place. The strips run across the entire width of the protector so that the protector can be rolled up or contoured to the shape of the automobile fender. However, this protector cannot be easily flexed across its width due to the long magnetic strips and thus the protector cannot be folded widthwise for storage or ease in portability. Another disadvantage is that this protector must be used on relatively large span, fairly flat surfaces due to its unbendable long magnetic strips. The fender protector is not capable of supporting somewhat flexible but heavier tools because its two inch spaced narrow magnetic strips are not capable of providing sufficient magnetic field strength for heavy items.

SUMMARY OF THE INVENTION

The magnetic tool holder of the present invention comprises a main body made of a flexible material, comprising a front face, a rear face and an interior magnet holding portion and at least one set of a plurality of juxtaposed magnetic bars which are inserted in the magnet holding portion. The magnetic bars comprise a front face and a rear face which are both magnetic. The positioning of the front faces of the magnetic bars corresponds to the front face of the main body; likewise, the positioning of the rear faces of the magnetic bars corresponds to the rear face of the main body. Thus, the main body will attach to metallic objects or mounting surfaces on either face.

Preferably, the main body is made from two parallel sheets (or one sheet which is folded over) which are sealed together by sealing means after the magnetic bars are inserted into the magnet holding portion of the main body. The flexible material may be an insulative material if the holder is to be placed on a hot or an electrically conductive surface, to keep the tools from getting hot and/or to protect the user.

In the preferred embodiment, the magnetic tool holder comprises an apron portion, which extends from the main body, for protecting the mounting surface from the tools. Preferably, the main body and apron can be folded.

Preferably, the holder further comprises holding means, such as loops, which extend from the main body to aid in removing the holder from the mounting surface and to carry or store the holder. The apron portion may comprise pocket(s) and/or loop(s) to hold various objects, such as plastic, wooden, or non-metallic tools.

In the preferred embodiment, the magnetic tool holder can be folded so that the portability of the holder is enhanced. In such an embodiment, the polarity of the magnetic bars must be such as to allow the sets of magnetic bars to attract and not repel. Thus, for a holder having two sets of magnetic bars in series, there must be a sufficient predetermined space between the sets of magnetic bars to allow the main body to be folded and the polarity of the magnetic bars in one set must be opposite to the polarity of the magnetic bars in the other set. Such an arrangement allows the main body to be folded either way and magnetically held face to face.

In an alternative embodiment, the magnetic tool holder further comprises attachment means for attaching the holder to a user. With this embodiment, the holder could be removed from the user and mounted on another type of mounting surface when the user is in a particular work area.

Accordingly, it is an object of the present invention to provide a magnetic tool holder which is portable so that tools and small parts can be easily accessed.

Another object of the present invention is to provide a magnetic tool holder which can attach to magnetically responsive objects or surfaces having varying contours.

Still another object of the present invention is to provide a magnetic tool holder in which the magnets serve two functions; to hold tools and to retain the holder in position on a surface.

Yet another object of the present invention is to provide a magnetic tool holder which is easy to use and inexpensive to produce.

Other objects and further scope of applicability of the present invention will become apparent from the detailed description to follow, taken in conjunction with the accompanying drawing.

DESCRIPTION OF THE PREFERRED EMBODIMENT

The present invention provides users with a temporary, portable and easily repositionable magnetic tool holder which can be positioned on magnetically responsive mounting surfaces having varying contours. The magnetic tool holder of the invention can be used by mechanics, plumbers, oil drillers, or the like, to hold tools, such as screwdrivers, pliers, or wrenches; by office workers for office tools such as scissors and letter openers; by dentists and doctors for holding the tools of their trade; restaurant or household workers for tools, i.e. kitchen or garden; and by sports enthusiasts, including underwater activities such as holding scuba diving tools. Uses of the present invention are not limited to the above-described uses or activities; the present invention can be used in almost any application requiring the holding of tools. The use of the word "tool" throughout the specification and claims includes any metallic object. Such objects can include hand-held tools, industrial tools and hardware (nails, nuts, bolts, paperclips, and the like). The use of the term "metal" or "metallic" throughout the specification and claims means any material, metal or alloy which is attracted to a magnet.

Figure 1:
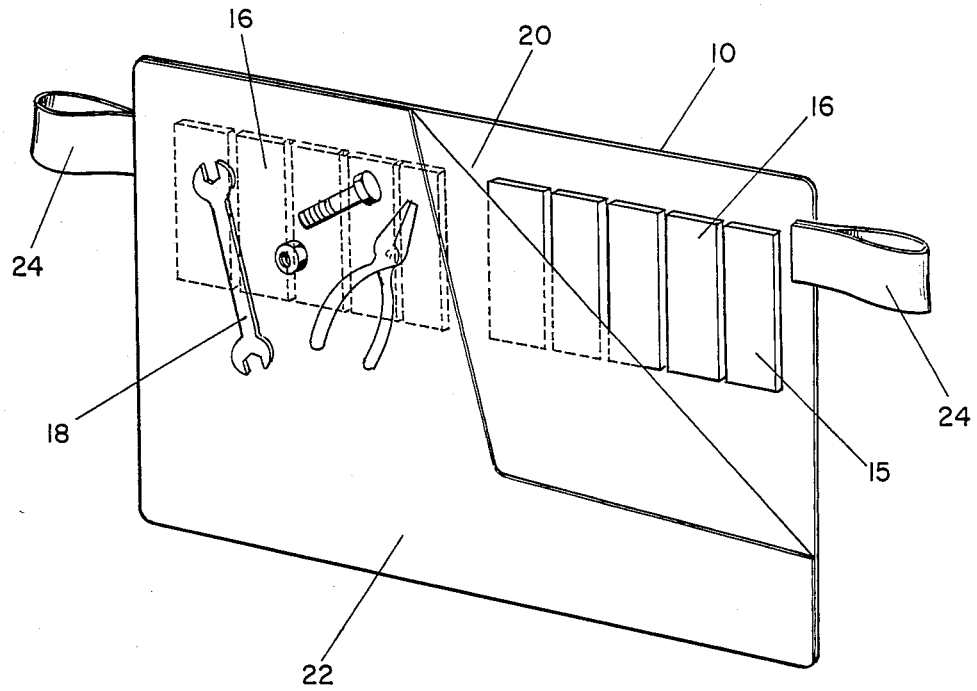
FIG. 1 of the drawing illustrates a preferred embodiment of a magnetic tool holder in accordance with the invention showing attached tools.

The drawing illustrates the magnetic tool holder of the present invention comprising a main body 10 having a front face 12 and a rear face 14 and an interior magnet holding portion 15 for holding at least one set of magnets. One corner of the main body 10 of FIG. 1 is shown folded back to illustrate the interior magnet holding portion 15 of the main body 10 into which the magnetic bars 16 are inserted. Each set of magnets comprises a plurality of juxtaposed (side by side) magnetic bars 16 which are positioned in the interior portion 15 of the main body 10 such that the faces of the magnetic bars 16 will attract metal on both the front face 12 and the rear face 14 of the main body 10. With this positioning of the magnetic bars 16, the holder can be attached to and easily pulled away from a mounting surface and repositioned on another mounting surface. One face of the main body 10 is mounted on a metallic surface to position the holder so that a user can access tools 18. The other face of the main body 10 is used to hold tools 18. For example, if the rear face 14 of the main body 10 is attached to an automobile hood, then the front face 12 of the main body can be used to hold tools 18.

The main body 10 is made of a flexible material so that the holder can be positioned on mounting surfaces having varying contours, such as an uneven or a curved surface. For example, the holder can be positioned on a round pipe or column due to the flexible main body 10 and the side by side positioning of the plurality of relatively narrow magnetic bars 16. Similarly, the holder can be securely mounted on a concave surface, such as the inside of a boat for keeping track of fishing gear. While the magnetic bars 16 may be of any shape, even round or oval, they are preferably of a size and shape to allow the tool holder to conform to a variety of surfaces. It has been found that relatively long, and somewhat narrow, aligned magnetic bars 16 perform well. Although the drawing shows magnetic bars !6 having sharp edges, the edges may be rounded or smoothed to facilitate the flexibility. Flexible materials which are useful for the main body 10 include, but are not limited to, leather, simulated leather, plastic and cloth. The material selected for the main body 10 may also be an insulative material, such as polycarbonate, for placement of the holder on a hot or electrically conductive mounting surface. Such a material would prevent the tools from getting hot and could also offer protection for the user against the heat or electrical conductivity of the mounting surface.

Figure 2:
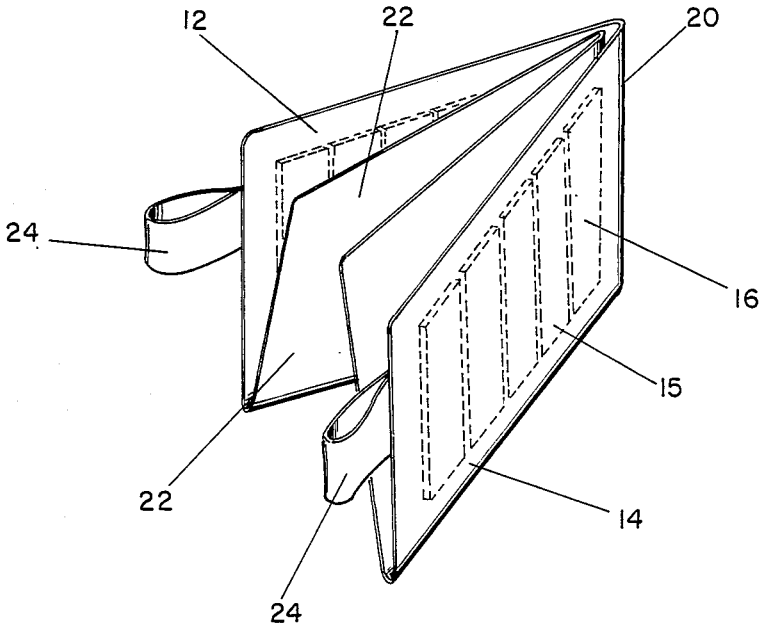
FIG. 2 of the drawing illustrates the magnetic tool holder of FIG. 1 in a folded or storage position.

FIGS. 1 and 2 illustrate the preferred embodiment of the invention wherein the magnetic tool holder comprises at least two sets of magnetic bars 16 positioned in series, with a space 20 between the sets. The sets may be positioned side by side (as shown in FIG. 1) or up and down on the main body 10 with respect to each other or otherwise suitably arranged.

Figure 3:
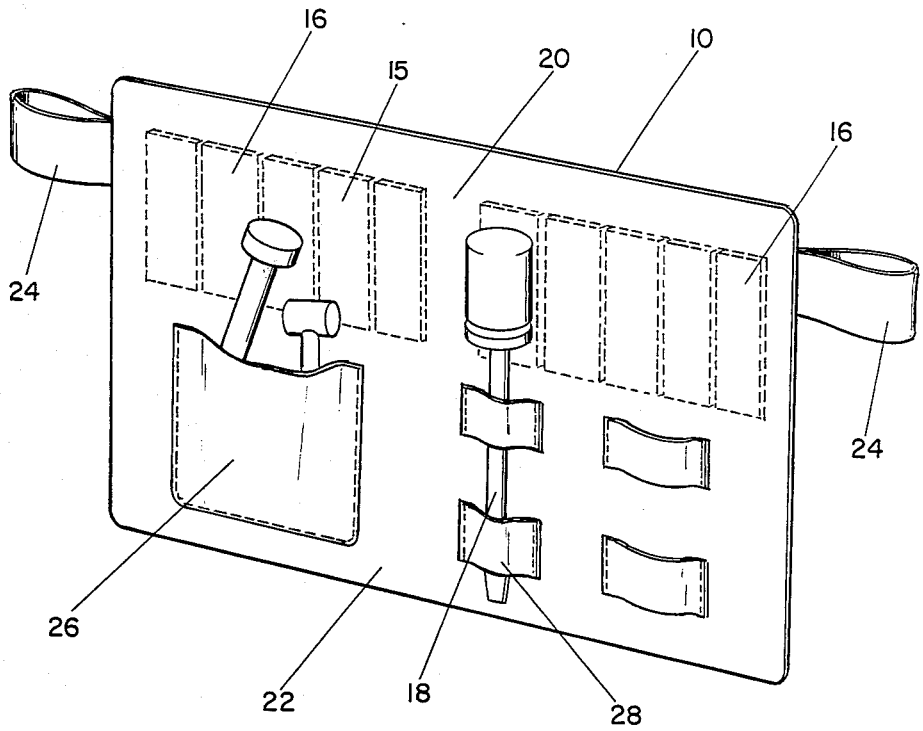
FIG. 3 of the drawing illustrates an alternative embodiment of the invention having a pocket and loops.

The preferred magnetic tool holder of the invention further comprises an apron portion 22 which extends from the main body (see FIGS. 1–3). This apron portion 22 protects the mounting surface which the holder is attached to from being scratched or otherwise harmed by the tools 18 positioned on the holder which hang from the magnetic bar set(s) of the holder.

Preferably, the main body 10 comprises two pieces of material (or one piece of material which is folded over) so that one piece becomes the front face 12 and another piece becomes the rear face 14 of the main body 10. The two faces are sealed by sealing means, common to the art, such as stitching or gluing, to hold the magnetic bars 16 in the interior magnet holding portion. FIG. 1 shows an elongation of the material to form an apron portion 22 that extends from the main body 10. The apron portion 22 need not be made of two pieces of material as shown in FIGS. 1–3. For example, a single piece of material could extend from the main body 10 as the apron portion 22.

The preferred holder of the invention further comprises holding means, such as loops 24 (shown in FIGS. 1–3), hooks or clamps, which extend from the main body 10 for ease in carrying or storing the holder. In the preferred embodiment shown in FIGS. 1–3, the loops 24 serve two functions. First, the user may insert a finger into loop(s) 24 and pull on the loop(s) 24 away from the mounting surface, and thereby easily remove the holder from the mounting surface; or pull on the loops 24 to unfold the holder. Second, the loops 24 can be used to hang the holder either for use or storage. The holder could be affixed to a user's belt or pants belt loop or carried in a pocket. Similarly, the holder could be hung on an object, such as a nail or hook, to allow use or storage of the holder.

The preferred magnetic tool holder of FIG. 1 is shown in a folded position in FIG. 2. If the holder is be folded, the polarity of the magnetic bars 16 must be to enable both sets of magnetic bars 16 to attract each other upon folding of the holder. Thus, in looking at one face of the main body 10 opposing magnetic bars 16 in the sets have opposite polarities. There must be a space 20 of a sufficient size to enable the main body 10 to be folded. If the magnetic tool holder has an apron portion 22, such as shown in FIG. 2, the apron portion 22 may be folded on top of the sets of magnetic bars 16 prior to folding the main body 10 along the space 20. This will help in storing small metallic objects 18, such as nuts and bolts, within a folded holder to prevent them from being dislodged or lost. Preferably, the holder is small enough to fold, store and/or carry in a pocket or tool box.

In an alternative embodiment of the inv shown in FIG. 3, the magnetic tool holder further a pocket 26 and/or loop(s) 28 which are attached to a face of the apron portion 22 to hold various objects such as plastic or non-metallic parts, rubber washers, wooden objects such as pencils, or measuring devices such as rulers. The pocket 26 could also be used to hold bulky items such as tape measurers, rolls of adhesive tape or a work cloth. The apron portion 22 could also include a slit (not shown) for holding such objects.

Figure 4:
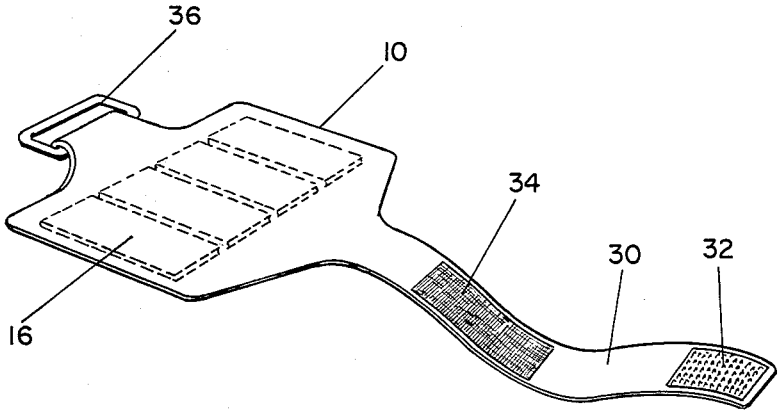
FIG. 4 of the drawing illustrates another alternative magnetic tool holder of the present invention which is a wrist-worn holder.

In another alternative embodiment the magnetic tool holder further comprises attachment means, such as clamps, clips, loops or straps to allow a user to wear the device on a wrist, waist, hip, thigh, chest or other body area. FIG. 4 shows a wrist-worn magnetic tool holder comprising a strap 30, a ring 36, and a hook 32 and loop 34 arrangement for attachment of the holder to a wrist. The set of magnets could be in juxtaposition along the arm, as shown in FIG. 4, or could be in juxtaposition perpendicular to the arm. The plurality of magnetic bars 16 in conjunction with the flexible material of the main body 10 enables the holder of the invention to bend with the motions of the wrist. Similarly, a holder worn on the waist or other body part, will bend to the contours of the body.

Although the invention has been described with reference to these preferred embodiments, other embodiments can achieve the same results. Variations and modifications of the present invention will be obvious to those skilled in the art and it is intended to cover in the appended claims all such modifications and equivalents. For example, although FIGS. 1-3 show only two sets of magnetic bars, the holder may comprise more sets of magnetic bars. As another example, an apron portion could be positioned between two sets of magnetic bars.

What is claimed is:

1. A foldable, portable tool holder comprising:

a generally rectangular main body of flexible material, said main body comprising a front face, a rear face, an upper edge, a lower edge, and two side edges, said main body further comprising two upper areas, each said upper area comprising an interior magnet holding portion, said main body further comprising an apron portion disposed beneath said two upper areas, said main body being readily bilaterally foldable twice, firstly by folding said apron portion together with said upper areas so that said lower edge of said main body generally meets with said upper edge of said main body, and secondly by folding said upper areas, covered by said apron portion, together so that said side edges of said main body generally meet; and at least two sets of a like plurality of magnetic bars, each set of magnetic bars being similarly disposed in a different one of said interior magnet holding portions of said upper areas of said main body, each set of magnetic bars comprising a line of spaced, parallel magnetic bars, said lines of bars being disposed substantially parallel to said upper and lower edges, and the longitudinal axes of said bars being positioned essentially perpendicular to said upper and lower edges, said sets of magnetic bars being disposed spaced apart from one another, said magnetic bars having sufficient magnetic strength that metal will adhere to both said front and said rear faces of said main body.

2. A magnetic tool holder in accordance with claim 1 further comprising holding means disposed on opposite sides of said main body.

3. A magnetic tool holder in accordance with claim 1 wherein said holding means comprises loop means attached to opposite sides of said main body at said side edges of said upper areas containing said magnetic bars, whereby said holding means can be used in folding, unfolding, carrying and storing said tool holder.

4. A magnetic tool holder in accordance with claim 1 further comprising at least one pocket on said apron portion.

5. A magnetic tool holder in accordance with claim 1 further comprising at least one loop on said apron portion.

6. A magnetic tool holder in accordance with claim 1 further comprising at least one holding loop extending from said main body.

7. A magnetic tool holder in accordance with claim 1 further comprising attachment means for attaching said holder to a user.

8. A magnetic tool holder in accordance with claim 1 wherein said main body is made of an insulative flexible material.

9. A magnetic tool holder in accordance with claim 1 wherein said main body comprises material sufficiently flexible for said tool holder to conform to substantially curved surfaces.

* * * * *